US008141863B2

(12) United States Patent
Nakamura et al.

(10) Patent No.: US 8,141,863 B2
(45) Date of Patent: Mar. 27, 2012

(54) SHEET PROCESSING APPARATUS

(75) Inventors: Tsuyoshi Nakamura, Ebina (JP); Toshio Kawachidani, Ebina (JP); Yoshimasa Sasaoka, Ebina (JP); Ryuuichi Shiraishi, Ebina (JP); Munetake Nagata, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 232 days.

(21) Appl. No.: 12/397,601

(22) Filed: Mar. 4, 2009

(65) Prior Publication Data

US 2009/0243182 A1 Oct. 1, 2009

(30) Foreign Application Priority Data

Mar. 26, 2008 (JP) ..... 2008-081623

(51) Int. Cl.
*B65H 37/04* (2006.01)

(52) U.S. Cl. ..... 270/58.13; 270/52.18; 270/58.07; 270/58.08; 270/58.09; 270/58.11; 270/58.12; 270/58.27; 270/58.28

(58) Field of Classification Search ..... 270/37, 270/52.18, 58.07, 58.08, 58.09, 58.11, 58.12, 270/58.13, 58.14, 58.15, 58.16, 58.18, 58.19, 270/58.27, 58.28
See application file for complete search history.

(56) References Cited

U.S. PATENT DOCUMENTS

| | | | | |
|---|---|---|---|---|
| 5,172,162 | A * | 12/1992 | Taneda | 399/12 |
| 7,077,393 | B2 * | 7/2006 | Ishida | 270/37 |
| 7,198,268 | B2 * | 4/2007 | Yamada et al. | 271/303 |
| 2006/0019811 | A1 * | 1/2006 | Ikeda et al. | 493/444 |
| 2009/0179373 | A1 * | 7/2009 | Awano et al. | 270/58.08 |

FOREIGN PATENT DOCUMENTS

| | | |
|---|---|---|
| JP | 2000-128420 | 5/2000 |
| JP | 2001-097625 | 4/2001 |
| JP | 3577894 B | 7/2004 |
| JP | 2008-050170 | 3/2008 |

* cited by examiner

*Primary Examiner* — Leslie A Nicholson, III
(74) *Attorney, Agent, or Firm* — Morgan, Lewis & Bockius LLP

(57) ABSTRACT

The sheet processing apparatus is provided with: a sheet aligning part that accumulates and aligns sheets so as to generate a bundle of sheets; an edge stitching processor that performs an edge stitching process by which the generated bundle of sheets is stitched together at one edge of the bundle of sheets; an apparatus housing that includes an opening portion through which the bundle of sheets is discharged to an outside of the apparatus housing; a saddle stitching processor that performs, outside of the apparatus housing, a saddle stitching process by which the discharged bundle of sheets is stitched together at a center portion of the bundle of sheets in a transporting direction of the bundle of sheets; and a stacking tray that is provided below the opening portion and outside the apparatus housing, and on which the bundles of sheets subjected to the edge stitching process and the saddle stitching process are capable of being stacked.

10 Claims, 6 Drawing Sheets

SHEET PROCESSING APPARATUS

CROSS REFERENCE TO RELATED APPLICATIONS

This application is based on and claims priority under 35 USC §119 from Japanese Patent Application No. 2008-81623 filed Mar. 26, 2008.

BACKGROUND

1. Technical Field

The present invention relates to a sheet processing apparatus that processes sheets.

2. Related Art

In general, post-processing apparatuses are available as standard or optional equipment for image forming apparatuses, such as printers. Such post-processing apparatuses perform predetermined post-processing on sheets having images formed thereon, in response to the demands from users.

SUMMARY

According to an aspect of the present invention, there is provided a sheet processing apparatus, including: a sheet aligning part that accumulates and aligns sheets so as to generate a bundle of sheets; an edge stitching processor that performs an edge stitching process by which the bundle of sheets generated in the sheet aligning part is stitched together at one edge of the bundle of sheets; an apparatus housing that includes an opening portion through which the bundle of sheets is discharged to an outside of the apparatus housing; a saddle stitching processor that performs, outside of the apparatus housing, a saddle stitching process by which the bundle of sheets discharged through the opening portion is stitched together at a center portion of the bundle of sheets in a transporting direction of the bundle of sheets; and a stacking tray that is provided below the opening portion and outside the apparatus housing, and on which the bundle of sheets subjected to the edge stitching process in the edge stitching processor is capable of being stacked, and the bundle of sheets subjected to the saddle stitching process in the saddle stitching processor is also capable of being stacked.

BRIEF DESCRIPTION OF THE DRAWINGS

Exemplary embodiment (s) of the present invention will be described in detail based on the following figures, wherein:

FIG. 2 is a diagram showing the configuration of a sheet aligning part, an edge stitching process part, a stacking tray, the saddle stitching process part, and the like;

DETAILED DESCRIPTION

Hereinafter, exemplary embodiments for carrying out the present invention will be described in detail with reference to the accompanying drawings.

First Exemplary Embodiment

Figure 1:
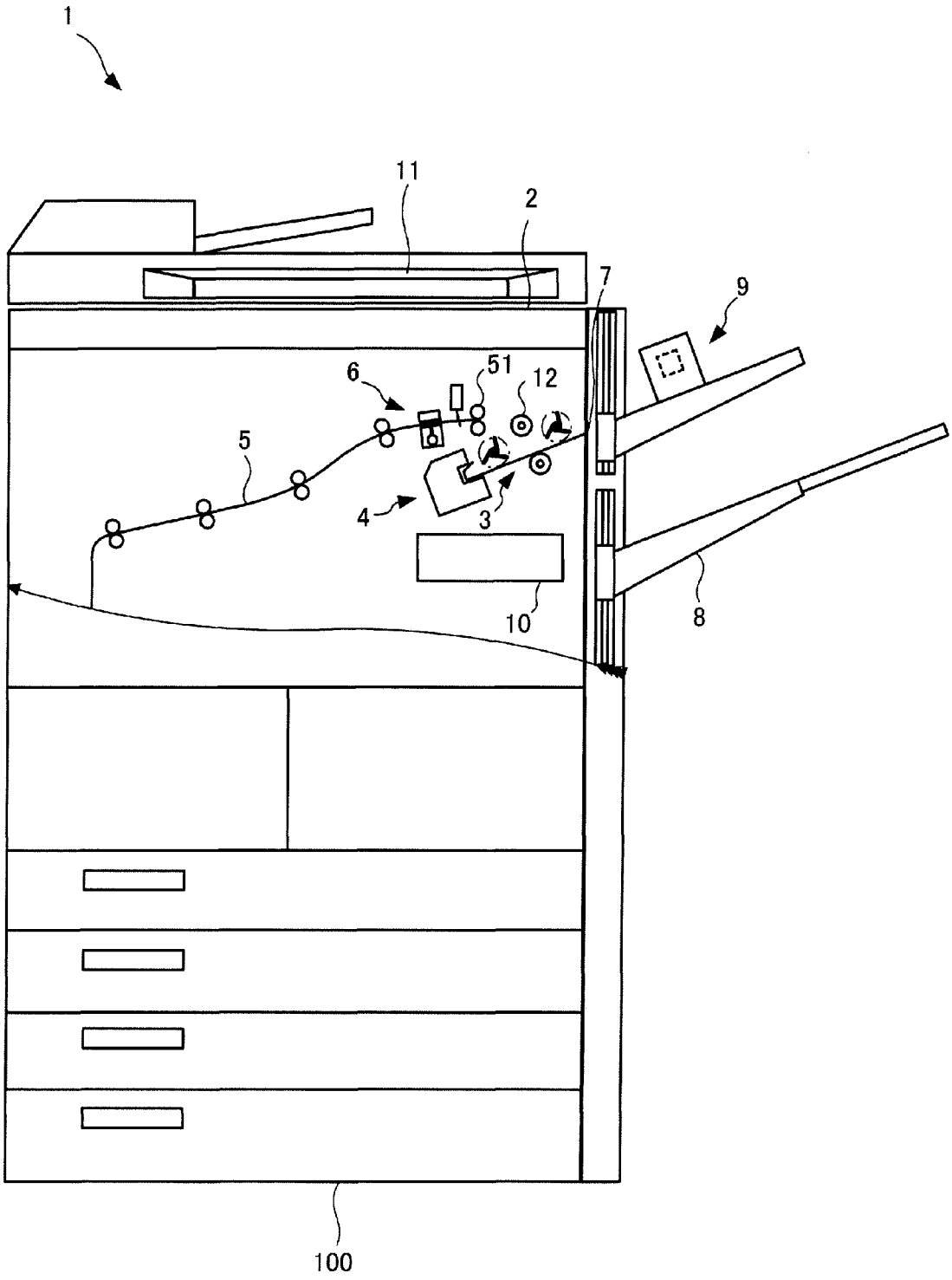
FIG. 1 is a view of a schematic configuration of an image forming apparatus employing a sheet processing apparatus according to a first exemplary embodiment.

FIG. 1 is a view of a schematic configuration of an image forming apparatus 1 employing a sheet processing apparatus according to a first exemplary embodiment, seen from a front side thereof.

The image forming apparatus 1 includes: an image reading part 2 and a sheet feeding unit (not shown in the figure). The image reading part 2 is arranged at an upper position inside an apparatus housing 100 of the image forming apparatus 1, and optically reads an image. The sheet feeding unit is arranged at a lower position inside the apparatus housing 100, and feeds sheets. In addition, the image forming apparatus 1 includes an image forming part (not shown in the figure) and a fixing part (not shown in the figure), both of which are arranged at a middle position, above the sheet feeding unit, inside the apparatus housing 100. The image forming part forms a toner image on a sheet fed by the sheet feeding unit. The fixing part fixes the toner image formed on the sheet by the image forming part.

Moreover, the image forming apparatus 1 includes a sheet aligning part 3 and an edge stitching process part 4, both of which are disposed below the image reading part 2 inside the apparatus housing 100. The sheet aligning part 3 collects sheets each having a toner image fixed thereon by the fixing part, and then bundles and aligns the collected sheets. The edge stitching process part 4 serves as an edge stitching processor that performs an edge stitching process by which a bundle of sheets aligned by the sheet aligning part 3 is stitched together at one edges of the respective sheets. Further, the image forming apparatus 1 includes a sheet transport path 5 and a creasing part 6 on the sheet transport path 5. The sheet transport path 5 extends from the fixing part to the sheet aligning part 3 at a middle position inside the apparatus housing 100. Through the sheet transport path 5, the sheets each having a toner image fixed thereon by the fixing part are transported, and the creasing part 6 performs processing to make a crease in each sheet. Furthermore, the image forming apparatus 1 includes an opening portion 7 formed in a side wall surface of the apparatus housing 100. Through the opening portion 7, the sheets are discharged from the apparatus housing 100.

In addition, the image forming apparatus 1 includes a stacking tray 8 and a saddle stitching process part 9. The stacking tray 8 is disposed below the opening portion 7 and outside the apparatus housing 100, and the saddle stitching process part 9 is disposed above the stacking tray 8 outside the apparatus housing 100. The saddle stitching process part 9 serves as a saddle stitching processor that performs a saddle stitching process by which the bundle of sheets discharged through the opening portion 7 is stitched together at the center portion thereof in a transporting direction of the bundle of sheets.

Moreover, the image forming apparatus 1 includes a controller 10 and an operating part 11. The controller 10 is disposed inside the apparatus housing 100 and the controller 10 controls the above described units and parts. The operating part 11 is disposed at a position outside the apparatus housing 100, on the front surface side, in the upper portion of the image forming apparatus 1.

Here, the sheet processing apparatus according to the first exemplary embodiment is designed to perform post-processing on the sheets each having a toner image formed thereon by the image forming part and fixed thereto by the fixing part in the image forming apparatus 1. The sheet processing apparatus is configured of the sheet aligning part 3, the edge stitching process part 4, the creasing part 6, the stacking tray 8, the saddle stitching process part 9, and the like. In addition, the sheet processing apparatus is provided inside the apparatus housing 100 of the image forming apparatus 1, or on the side wall surface of the apparatus housing 100, as described above.

Hereinafter, the function of each constituent element will be described.

The image reading part 2 includes photoreceptors, a platen glass, and the like. The image reading part 2 irradiates a document placed on the platen glass with light so as to read the reflection light by using the photoreceptors, and then image data is generated by the controller 10 on the basis of the result of the reading.

The image forming part forms an image on the basis of the image data generated as described above, and also forms an image on the basis of image data supplied thereto from an external apparatus, such as a personal computer (not shown in the figure).

The sheet feeding unit includes: multiple sheet cassettes that house various types of sheets; multiple feed rollers that send out the sheets from the sheet cassettes; and multiple transporting rollers that transport the sheets. The sheet feeding unit feeds the sheets to the image forming part at the time of image formation.

The fixing part includes a fixing device having a roller and a pressurizing member. The roller includes a heat source inside thereof. The fixing part causes a sheet to pass through a nip region formed by the roller and the pressurizing member, and thus fixes a toner image on the sheet with heat and pressure being applied thereto.

The controller 10 includes a Central Processing Unit (CPU), a Read Only Memory (ROM), a Random Access Memory (RAM), and the like, and controls each unit of the image forming apparatus 1 by executing various application programs and arithmetic processing. The operating part 11 includes a liquid-crystal display and multiple buttons, and receives various instructions, such as selection of an image forming mode and selection of a stitching process mode, inputted thereto by a user.

Next, the sheet aligning part 3, the edge stitching process part 4, the stacking tray 8, the saddle stitching process part 9, and the like will be described in detail.

Figure 2:
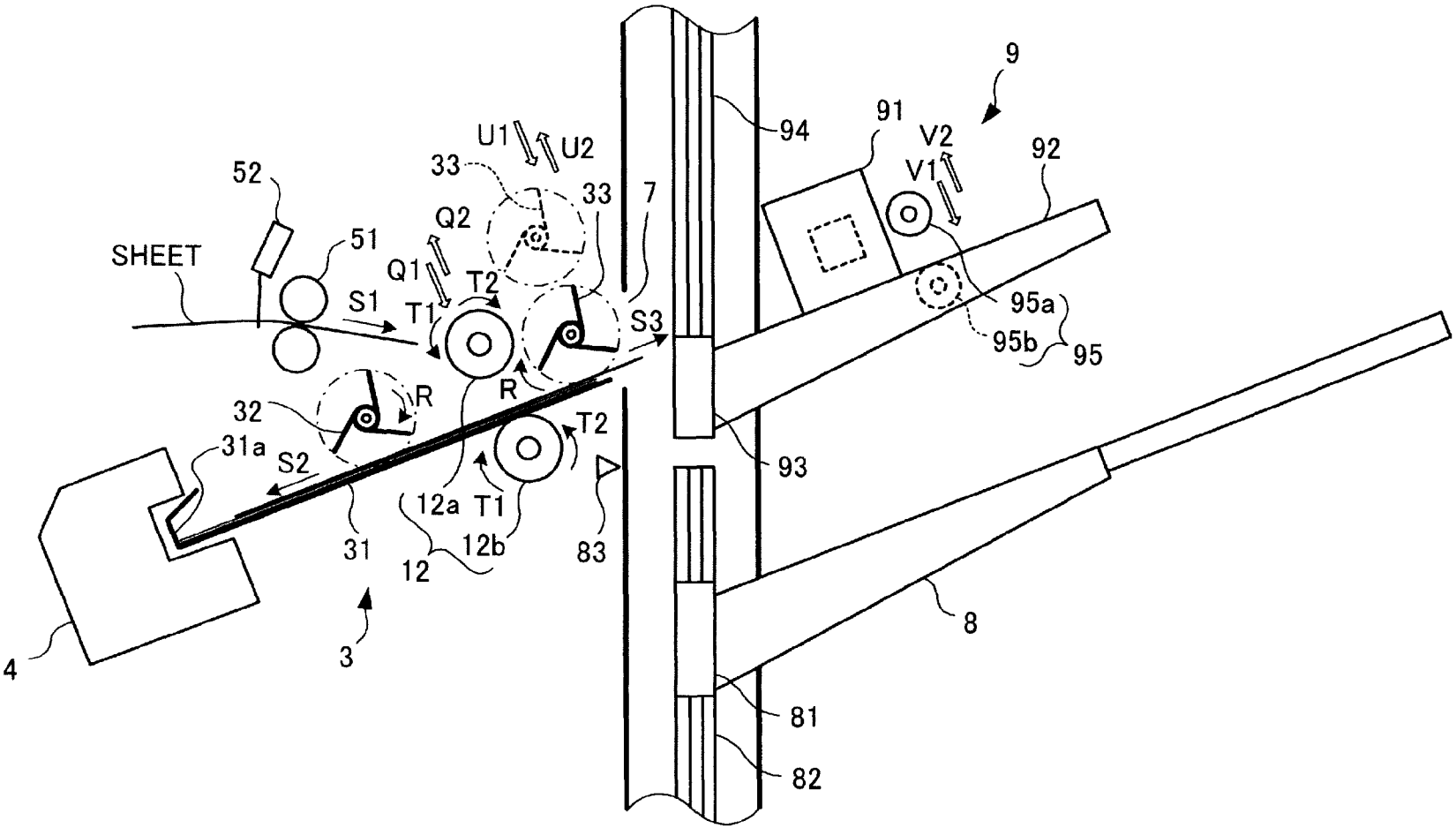

FIG. 2 is a diagram showing the configuration of the sheet aligning part 3, the edge stitching process part 4, the stacking tray 8, the saddle stitching process part 9, and the like.

The sheet aligning part 3 includes a compile tray 31 that collects and houses multiple sheets. The compile tray 31 is provided with an end guide 31*a*, which is formed with a surface extending from a bottom surface of the compile tray 31 in a direction perpendicular to the bottom surface, and which aligns the trailing edges of sheets when a bundle of sheets is generated. The end guide 31*a* may be formed, for example, by folding the bottom surface of the compile tray 31 in a case where the compile tray 31 is formed of a sheet metal or the like.

In addition, the sheet aligning part 3 includes a main paddle 32 and a sub paddle 33, both of which rotate in order to push the trailing edges of the sheets toward the end guide 31*a*. The main paddle 32 and the sub paddle 33 rotate in a direction indicated by an arrow R in FIG. 2 so as to push, into a direction indicated by an arrow S2 in FIG. 2, the sheets on the compile tray 31, which had been transported to the main paddle 32 and the sub paddle 33 in a direction indicated by an arrow S1 in FIG. 2. Note that, the sub paddle 33 moves in a direction indicated by an arrow U1 in FIG. 2 so as to come into contact with the sheet, and moves in a direction indicated by an arrow U2 in FIG. 2 so as to be separated from the sheet.

Moreover, the sheet aligning part 3 includes a tamper laid on the compile tray 31 in a manner of extending in the direction perpendicular to a transporting direction (pushing direction) of the sheet (that is, on the front side (OUT side) and the back side (IN side) of the sheet surface of FIG. 2). The tamper is provided to position sheets in terms of the two ends (the two sides in the direction perpendicular to the transporting direction of the sheet) of the sheet. However, the tamper is not shown in FIG. 2.

In addition, the image forming apparatus 1 includes exit rollers 51 and an exit sensor 52. The exit rollers 51 are a pair of rollers that are disposed on the sheet transport path 5 and discharge the sheet toward the compile tray 31. The exit sensor 52 is disposed at a position upstream of the exit rollers 51 and downstream of the creasing part 6 on the sheet transport path 5, and the exit sensor 52 detects the sheets.

Moreover, the image forming apparatus 1 includes eject rollers 12 that discharge, through the opening portion 7 to the outside of the apparatus housing 100, the bundle of sheets accumulated on the compile tray 31. The eject rollers 12 include a first eject roller 12*a* and a second eject roller 12*b* as illustrated in FIG. 2. The first and second eject rollers 12*a* and 12*b* are configured to operate as follows. When the bundle of sheets is to be generated (compiled), the first eject roller 12*a* and the second eject roller 12*b* are moved away from each other, in other words, the first eject roller 12*a* ascends (moves in a direction indicated by an arrow Q2). On the other hand, when the bundle of sheets is to be discharged through the opening portion 7, the first eject roller 12*a* descends (moves in a direction indicated by an arrow Q1) so as to come into contact with the bundle of sheets.

The edge stitching process part 4 includes a staple head (not shown in the figure), a base (not shown in the figure), and rails (not shown in the figure). The staple head actually performs the stitching process by which the bundle of sheets aligned by the sheet aligning part 3 is stitched together at one edge of the bundle of sheets. The base supports the staple head, and the rails are formed on the base and form a pathway on which the staple head moves. The rails are formed so as to extend respectively along edge portions of the compile tray 31, and the staple head moves on the rails so as to perform the stitching process. Moreover, the edge stitching process part 4 includes a staple-move motor (not shown in the figure), a staple-move home sensor (not shown in the figure), and a staple center position sensor (not shown in the figure). The staple-move motor is a stepping motor (not shown in the figure) that moves the staple head. The staple-move home sensor detects a home position of the staple head, while the staple center position sensor detects a center position of the staple head.

When one-point stitching is to be performed on the bundle of sheets on the compile tray 31, the staple head stays at a first home position detected by the staple-move home sensor, and successively performs the stitching process at necessary timings.

On the other hand, when two-point stitching is to be performed on the bundle of sheets, the staple head first stands by at a second home position detected by the staple center position sensor. Thereafter, after the certain number of sheets are stacked on the compile tray 31, the staple-move motor is driven to move the staple head to a stitching position. In this way, the staple head performs the stitching process at two points on the bundle of sheets.

The creasing part 6 (see FIG. 1) includes, for example, a creasing plate member having a thin tip with a small width and protruding toward the sheet transport path 5 from a lower portion of the creasing part 6 illustrated in FIG. 1. The creasing part 6 makes a crease in, for example, the center (center portion in the transporting direction of the sheet) of the sheet by use of the creasing plate member.

The stacking tray 8 is fastened and supported on a slider 81 with screws or the like. The slider 81 is fitted into a tray guide 82 so as to be movable upward and downward. The tray guide 82 is provided to the apparatus housing 100 on the side wall surface side thereof. The stacking tray 8 is movable upward and downward along the tray guide 82. Note that, the ascending and descending mechanism of the slider 81 on the tray guide 82 may be achieved by using any of various known ascending and descending mechanisms. For example, a mechanism may be employed in which a driving motor (not shown in the figure) that is controlled by the controller 10, a belt (not shown in the figure) that converts a rotational driving force of the driving motor into the ascending and descending movement of the slider 81 and the like are included.

In addition, the positioning of the stacking tray 8 is carried out as follows. When sheets are to be stacked on the stacking tray 8, the stacking tray 8 is positioned so that a sheet stacking surface of the stacking tray 8 is located at a position which is away from the opening portion 7, by a predetermined distance below, provided in the side wall surface of the apparatus housing 100. After that, once sheets start to be stacked, the stacking tray 8 is positioned in such a manner as to gradually descend, by a predetermined amount at every time, so that the height of the uppermost surface of the bundle of sheets stacked on the stacking tray 8 is always located at the predetermined distance away from the opening portion 7.

The positioning of the stacking tray 8 is carried out on the basis of detection of an upper sensor 83 that is an optical sensor provided slightly above an upper end portion of the tray guide 82 inside the apparatus housing 100. The upper sensor 83 detects one of the upper surface of the stacking tray 8 and the upper surface of sheets stacked on the stacking tray 8, when the one of the upper position of the stacking tray 8 and the uppermost surface of the sheets stacked on the stacking tray 8 is moved to a position at a predetermined height from the tray guide 82.

The saddle stitching process part 9 includes a saddle stitching unit 91 and a frame 92. The saddle stitching unit 91 performs the saddle stitching process by which the bundle of sheets discharged through the opening portion 7 is stitched together at the approximately center portion of the bundle of sheets. The frame 92 supports the saddle stitching unit 91, and also supports the bundle of sheets when the saddle stitching unit 91 performs the saddle stitching process. The frame 92 is fastened and supported on a slider 93 with screws or the like, and the slider 93 is fitted into a frame guide 94 so as to be movable upward and downward. Here, the frame guide 94 is provided on the side wall surface side of the apparatus housing 100. With this configuration, the saddle stitching unit 91 is capable of ascending and descending along the frame guide 94. Note that, the ascending and descending mechanism of the slider 93 on the frame guide 94 may be achieved by using any of various known ascending and descending mechanisms. For example, there is a mechanism including a driving motor (not shown in the figure) that is controlled by the controller 10, and a belt (not shown in the figure) that converts a rotational driving force of the driving motor into the ascending and descending movement of the slider 93.

In addition, the saddle stitching process part 9 includes fall-down rollers 95 that transport, further downstream, the bundle of sheets subjected to the saddle stitching process by the saddle stitching unit 91, and then cause the bundle of sheets thus transported to fall down onto the stacking tray 8. The fall-down rollers 95 includes a first fall-down roller 95*a* and a second fall-down roller 95*b* as illustrated in FIG. 2. The first and second fall-down rollers 95*a* and 95*b* are configured to operate as follows. When the saddle stitching process is to be performed on the bundle of sheets, the first fall-down roller 95*a* and the second fall-down roller 95*b* are moved away from each other, in other words, the first fall-down roller 95*a* ascends (moves in a direction indicated by an arrow V2). On the other hand, when the bundle of sheets is to be transported to the downstream side, the first fall-down roller 95*a* descends (moves in a direction indicated by an arrow V1) so as to come into contact with the bundle of sheets.

The saddle stitching unit 91 includes two staple heads (not shown in the figure) that actually perform the stitching process on the bundle of sheets transported thereto, at two points at the approximate center of the bundle of sheets in the transporting direction thereof, and the two points in a direction approximately perpendicular to the transporting direction thereof. In addition, the saddle stitching unit 91 includes a base (not shown in the figure) and rails (not shown in the figure). The base supports the staple heads, while the rails are formed on the base and form a pathway on which the staple heads move. The rails are formed to extend in the direction approximately perpendicular to the transporting direction of the bundle of sheets, and the two staple heads move on the rails and perform the stitching process. Note that, the staple heads are moved by a staple-move motor (not shown in the figure), which is a stepping motor (not shown in the figure), on the basis of detection values of a staple position sensor (not shown in the figure) that detects the positions of the staple heads.

Then, when the saddle stitching process is to be performed on the bundle of sheets having a first sheet width on the frame 92, the staple heads stay at a first stitching position, and successively perform the stitching process at necessary timings. On the other hand, when the saddle stitching process is to be performed on the bundle of sheets having a second sheet width, the staple heads stay at a second stitching position, and successively perform the stitching process at necessary timings.

Note that, the saddle stitching unit 91 ascends and descends within the following region. The lower limit position of the saddle stitching unit 91 is a position (first position) where the saddle stitching unit 91 may perform the saddle stitching process on the bundle of sheets discharged through the opening portion 7. Then, the saddle stitching unit 91 ascends from the first position to a position (second position) where the saddle stitching unit 91 does not interfere with sheets being discharged through the opening portion 7 and stacked on the stacking tray 8 in a case where the saddle stitching process is not performed.

Next, the operation of the sheet processing apparatus having the above-described configuration will be described.

First, consider a case where the user selects the edge stitching process as a post-processing mode through operation using the operating part 11 and the like. In this case, upon receipt of the selecting operation, the controller 10 first instructs the image forming part to perform an image forming process, and then instructs the edge stitching process part 4 to perform the edge stitching process. Meanwhile, the controller 10 causes the saddle stitching unit 91 to ascend to the second position described above.

In this way, a sheet having a toner image formed thereon in the image forming part, and being subjected to a fixing process in the fixing part, passes through the sheet transport path 5. Then, the sheet is detected by the exit sensor 52 and then transported by the exit rollers 51 in the direction indicated by the arrow S1, as illustrated in FIG. 2. The sheet transported in the direction indicated by the arrow S1 is further transported toward the compile tray 31 while passing between the first eject roller 12*a* of the eject rollers 12 and the main paddle 32. The sheet having reached the compile tray 31 is pushed into the direction indicated by the arrow S2 in FIG. 2 by the rotation of the descending sub paddle 33 (moving in the direction indicated by the arrow U1 in FIG. 2) in the direction indicated by the arrow R in FIG. 2 and the rotation of the main paddle 32 in the direction indicated by the arrow R in FIG. 2. Thus, the trailing edge of the pushed sheet comes into contact with the end guide 31*a* so as to be aligned. Then, at the timing when the sheet is received by the compile tray 31 and reaches the end guide 31*a*, the above-described tamper (not shown in the figure) moves in the direction perpendicular to the transporting direction of the sheet, and performs, sheet by sheet, the positioning of both ends of the sheet to be accumulated.

Thereafter, the preset number of sheets are accumulated on the compile tray 31, and aligned to generate a bundle of sheets. Then, the edge stitching process is performed on the bundle of sheets by the staple head having moved as corresponding to a stitching position. After the edge stitching process, the first eject roller 12*a* of the eject rollers 12 descends (moves in the direction indicated by the arrow Q1 in FIG. 2), so that the bundle of sheets is discharged onto the stacking tray 8 by the rotations of the first eject roller 12*a* and the second eject roller 12*b* in the direction indicated by an arrow T1 in FIG. 2.

On the other hand, consider a case where the user selects the saddle stitching process as the post-processing mode through operation using the operating part 11 and the like. In this case, upon receipt of the selecting operation, the controller 10 first instructs the image forming part to perform an image forming process, and then instructs the saddle stitching process part 9 to perform the saddle stitching process. Meanwhile the controller 10 causes the saddle stitching unit 91 to move to the above-described first position. The controller 10 also causes the first fall-down roller 95*a* to ascend (move in the direction indicated by the arrow V2 in FIG. 2).

In this way, a sheet having a toner image formed thereon in the image forming part and fixed thereto in the fixing part passes through the sheet transport path 5. Then, if a crease is to be made on the sheet, the creasing part 6 makes the crease in the sheet. The sheet having passed through the portion where the creasing part 6 is disposed is detected by the exit sensor 52 and then transported by the exit rollers 51 in the direction indicated by the arrow S1, as illustrated in FIG. 2.

After the bundle of sheets is generated on the compile tray 31 in the above-described manner, the first eject roller 12*a* of the eject rollers 12 descends (moves in the direction indicated by the arrow Q1 in FIG. 2). Then, the bundle of sheets as a whole is transported, in a direction indicated by an arrow S3 in FIG. 2, toward the saddle stitching unit 91 on the downstream side, by the rotations of the first eject roller 12*a* and the second eject roller 12*b* in the direction indicated by the arrows T1 in FIG. 2.

In the job start of the saddle stitching process, the saddle stitching unit 91 stands by at the above-described first or second stitching position according to the sheet size. After the bundle of sheets is supplied by the eject rollers 12, the saddle stitching unit 91 performs the stitching process on, for example, the portion creased by the creasing part 6, so that the bundle of sheets stitched at the center portion thereof is formed. After that, the first fall-down roller 95*a* descends (moves in the direction indicated by the arrow V1) to come into contact with the bundle of sheets, then transports the bundle of sheets to the downstream side in cooperation with the second fall-down roller 95*b*. As a result, the bundle of sheets is discharged onto the stacking tray 8 located below the saddle stitching process part 9.

As described above, in the sheet processing apparatus according to the first exemplary embodiment, the saddle stitching process part 9 is provided to be capable of ascending and descending above the stacking tray 8 outside the apparatus housing 100. Further, the position of the saddle stitching unit 91 is changed in accordance with whether the edge stitching process by the edge stitching process part 4 is performed or the saddle stitching process by the saddle stitching process part 9 is performed. This configuration allows both the bundle of sheets subjected to the edge stitching process in the edge stitching process part 4 and the bundle of sheets subjected to the saddle stitching process in the saddle stitching process part 9 to be stacked on the same stacking tray 8. Accordingly, it is not necessary for the sheet processing apparatus to include separate stacking trays respectively for the bundle of sheets subjected to the edge stitching process and the bundle of sheets subjected to the saddle stitching process. As a result, the configuration of the apparatus may be simplified and the size of the apparatus may be reduced.

Moreover, the stacking tray 8 is allowed to ascend and descend relative to the saddle stitching process part 9 (frame 92) located above the stacking tray 8. Accordingly, a larger amount of the bundle of sheets may be stacked on the stacking tray 8 in comparison with the case where the distance between the stacking tray 8 and the saddle stitching process part 9 (frame 92) is fixed.

Note that, although the saddle stitching process part 9 is capable of ascending and descending in the first exemplary embodiment, the present invention is not limited to this configuration, and the following configuration may also be employed. Specifically, the frame 92 that supports the saddle stitching unit 91 and supports the bundle of sheets when the saddle stitching process is performed thereon may be fixed to the apparatus housing 100 of the image forming apparatus 1, so that the bundle of sheets subjected to the edge stitching process is stacked on the stacking tray 8 by use of the fall-down rollers 95 as in the case of the stacking of the bundle of sheets subjected to the saddle stitching process on the stacking tray 8. Thus, this configuration further simplifies the structure.

Second Exemplary Embodiment

Hereinafter, an image forming apparatus 1 employing a sheet processing apparatus according to a second exemplary embodiment will be described.

In the second exemplary embodiment, a saddle stitching apparatus 90 (see FIG. 3) is provided above a stacking tray 8 on the side wall portion side of the image forming apparatus 1. The saddle stitching apparatus 90 is characterized as follows. Specifically, the saddle stitching apparatus 90 is not capable of ascending and descending relative to an apparatus housing 100 of the image forming apparatus 1, but stays at a predetermined position where the saddle stitching apparatus 90 performs a saddle stitching process. When the saddle stitching process is not performed, the saddle stitching apparatus 90 is retracted from a transport path for bundles of sheets extending from an opening portion 7 to the stacking tray 8. Note that, configurations other than the saddle stitching apparatus 90 are the same as those of the first exemplary embodiment, and accordingly, will not be described here in detail.

Here, the sheet processing apparatus according to the second exemplary embodiment is designed to perform post processing on the sheets each having a toner image formed thereon in the image forming part and fixed thereto by the fixing part in the image forming apparatus 1. The sheet processing apparatus includes the sheet aligning part 3, the edge stitching process part 4, the creasing part 6, the stacking tray 8, the saddle stitching apparatus 90, and the like, as described above. In addition, the sheet processing apparatus is disposed inside the apparatus housing 100 of the image forming apparatus 1, or attached to the side wall surface of the apparatus housing 100.

The saddle stitching apparatus 90 includes saddle stitching units 900 disposed above the stacking tray 8 outside the apparatus housing 100, as in the case of the first exemplary embodiment. The saddle stitching units 900 serve as a saddle stitching processor and perform the saddle stitching process by which the bundle of sheets discharged through the opening portion 7 is stitched together at the approximately center portion of the bundle of sheets. Then, the bundles of sheets after being subjected to the saddle stitching process by the saddle stitching units 900 are successively stacked on the stacking tray 8. When performing the stitching process, the saddle stitching units 900 are located on the sheet transport path for the bundles of sheets extending through the opening portion 7 to the stacking tray 8. When the bundle of sheet is to be discharged upon the completion of the stitching process, the saddle stitching units 900 is retracted from the sheet transport path in directions perpendicular to the transporting direction of the bundle of sheets.

Figure 3:
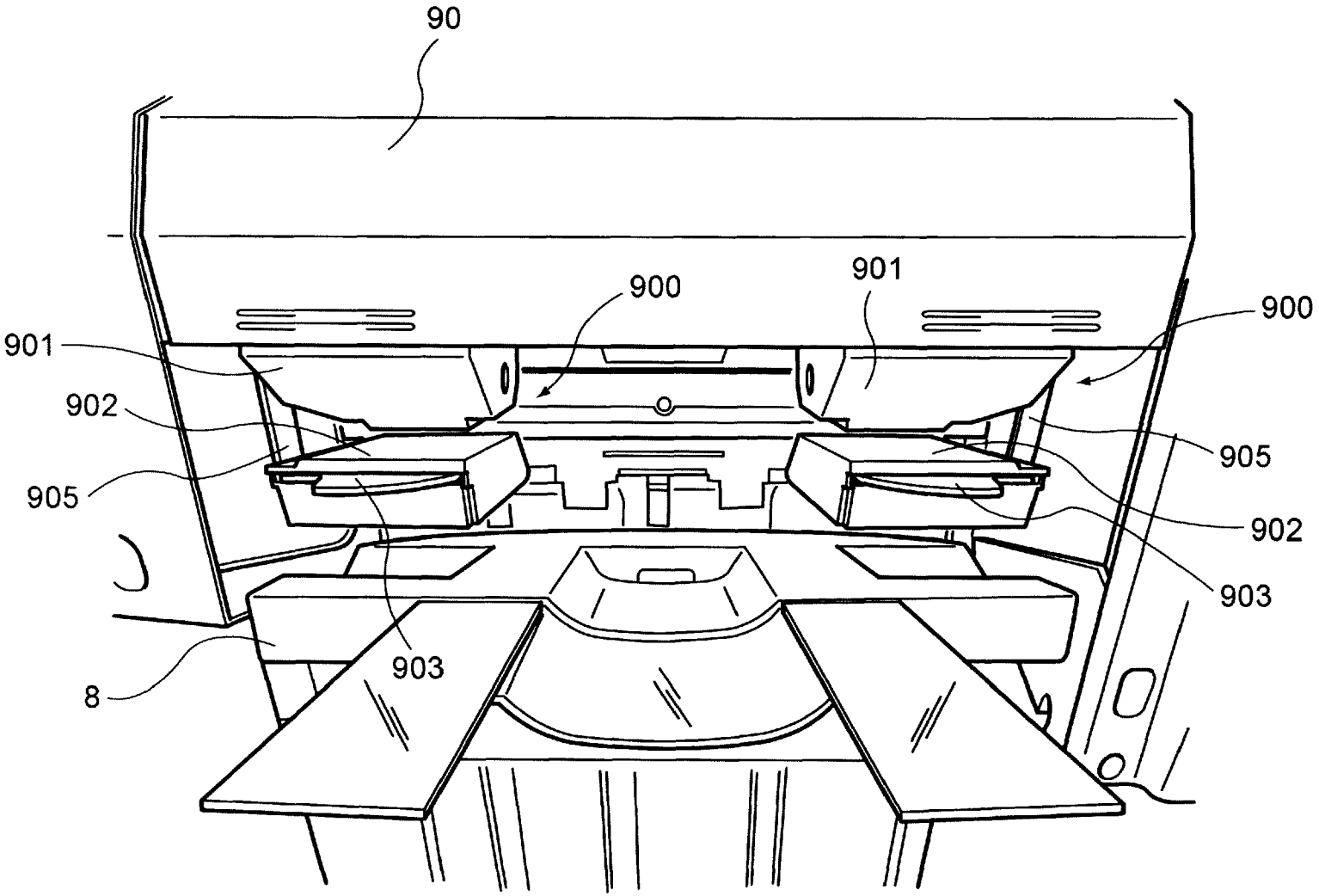
FIG. 3 illustrates a state where saddle stitching units are located on the sheet transport path.
Figure 4:
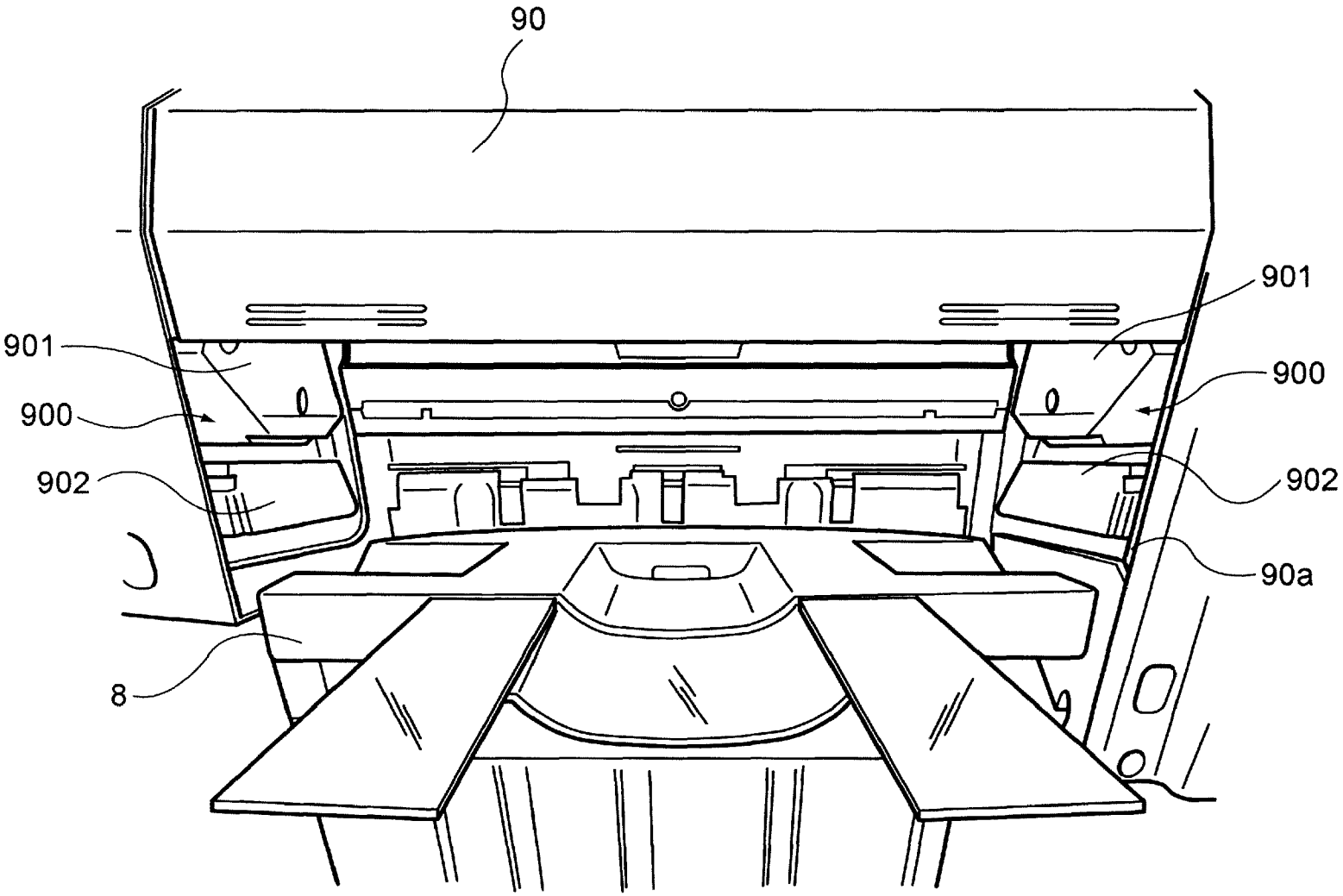
FIG. 4 illustrates a state where the saddle stitching units have been retracted from a sheet transport path.

FIG. 3 and FIG. 4 are perspective views of the opening portion 7 of the image forming apparatus 1 when viewed from the side where the sheets are discharged (the right side in FIG. 1). FIG. 3 illustrates a state where the saddle stitching units 900 are located on the sheet transport path (the state where the saddle stitching units 900 are located at the stitching position), while FIG. 4 illustrates a state where the saddle stitching units 900 have been retracted from the sheet transport path (the state where the saddle stitching units 900 have been retracted from the stitching position).

As illustrated in FIG. 3, each of the saddle stitching units 900 includes a unit upper portion 901, a unit lower portion 902, and a downstream-side shelf-type tray 903. Each of the unit upper portions 901 includes various kinds of mechanical components for a needle or a staple used in the stitching process. The unit lower portions 902 serve as a support structure that supports the bundle of sheets in the stitching operation performed by the unit upper portions 901. The downstream-side shelf-type trays 903 serve as a sheet bundle holding member that is deployed from the unit lower portions 902 and supports the bundle of sheets. In addition, each of the unit lower portions 902 is provided with an upstream-side shelf-type tray 904 (described later) that supports the bundle of sheets supplied to the saddle stitching units 900. Each of the unit upper portions 901 and the corresponding one of the unit lower portions 902 are integrated with each other by a connecting portion 905 provided at a position away from the sheet transport path.

The saddle stitching units 900 are retracted to the home positions inside a housing of the saddle stitching apparatus 90 as shown in FIG. 4 in a case where the power is turned off, a case where the bundle of sheets subjected to the edge stitching process is stacked, a case where the bundle of sheets is to be discharged after the saddle stitching process, or the like. Specifically, the saddle stitching units 900 are configured to be capable of being advanced from and retracted into the housing of the saddle stitching apparatus 90, respectively on both sides (IN side and OUT side (see FIG. 5, which will be described later) in the direction perpendicular to the transporting direction of the sheet). When being retracted, the saddle stitching units 900 are housed inside the housing of the stitching apparatus 90 respectively on both sides of the housing in the direction perpendicular to the transporting direction of the sheet. When the saddle stitching units 900 are housed in the saddle stitching apparatus 90, the downstream-side shelf-type trays 903 (see FIG. 3) come into contact respectively with beams 90*a* of the saddle stitching apparatus 90 so as to be housed in the corresponding unit lower portion 902. The downstream-side shelf-type trays 903 are rotatably supported by, for example, springs (which will be described later). In the transition from the state in FIG. 4 to the state in FIG. 3, the downstream-side shelf-type trays 903 protrude from the respective unit lower portions 902 by the reaction forces of the springs, and are deployed so as to be allowed to support the sheets as illustrated in FIG. 3.

Next, the operation of the saddle stitching units 900 will be described in further detail.

Figure 5:
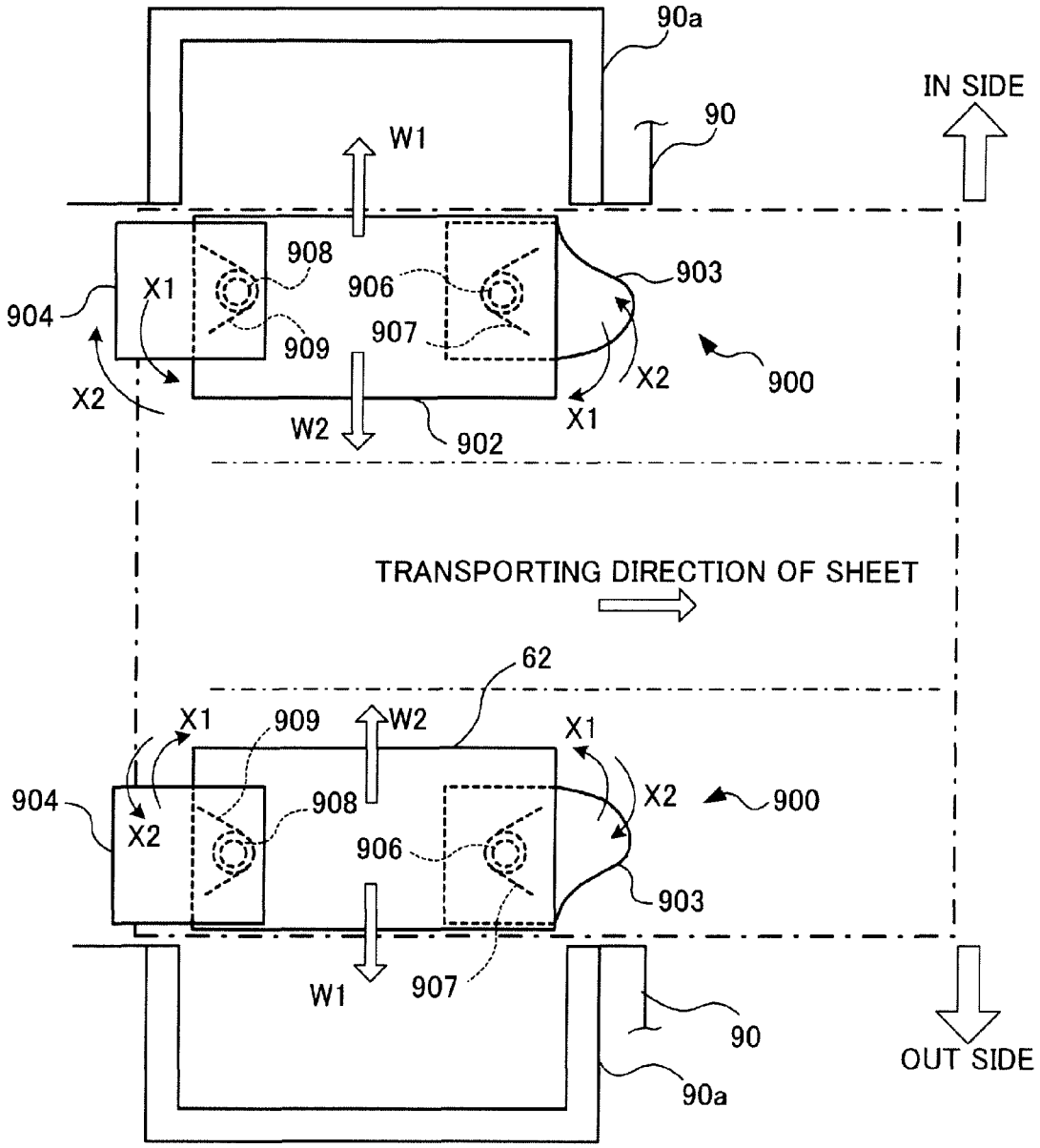
FIG. 5 illustrates a state where unit lower portions of the saddle stitching units are located at stitching positions.

FIG. 5 is an explanatory diagram for describing the motion of the saddle stitching units 900 illustrated in the perspective views of FIGS. 3 and 4. FIG. 5 particularly illustrates the unit lower portions 902, which are support structures, in the saddle stitching units 900. As illustrated in FIG. 5, the saddle stitching units 900 are capable of being advanced from and retracted into the two sides (the IN side and the OUT side in FIG. 5), in the direction perpendicular to the transporting direction of the sheet, of the saddle stitching apparatus 90. In addition, as shown in FIG. 5, the saddle stitching units 900 are located at the stitching positions on the sheet transport path to which the bundle of sheets is to be transported, and waits for the bundle of sheet being transported.

FIG. 5 illustrates a state where the unit lower portions 902 of the saddle stitching units 900 on the IN side and the OUT side are located at the stitching positions. In this state, the downstream-side shelf-type trays 903 are deployed respectively from the unit lower portions 902 and are located so as to be allowed to support the bundle of sheets at the portions downstream of the stitching positions. On the other hand, the upstream-side shelf-type trays 904 are also deployed respectively from the unit lower portions 902 and are located so as to be allowed to support the bundle of sheets at the positions upstream of the stitching positions. Each of the downstream-side shelf-type trays 903 is configured to be rotatable about a shaft 906, and is biased by a spring 907. Meanwhile, each of the upstream-side shelf-type trays 904 is configured to be rotatable about a shaft 908, and is biased by a spring 909.

Here, in the transition from the state in FIG. 3 to the state in FIG. 4, the saddle stitching units 900 move in directions indicated by arrows W1, respectively, in FIG. 5. At this moment, each of the lower-side shelf-type trays 903 comes into contact with the beam 90*a* of the saddle stitching apparatus 90 in association with the motion of the unit lower portion 902, and rotates about the shaft 906 in the direction indicated by an arrow X1 in FIG. 5 while being biased by the spring 907. On the other hand, each of the upstream-side shelf-type trays 904 comes into contact with the beam 90*a* of the saddle stitching apparatus 90 in association with the movement of the unit lower portion 902 in the same manner, and rotates about the shaft 908 in the direction indicated by the arrow X1 in FIG. 5 while being biased by the spring 909.

At this moment, that is, when the saddle stitching units 900 are housed in the housing of the saddle stitching apparatus 90, the downstream-side shelf-type trays 903 and the upstream-side shelf-type trays 904 are housed in the corresponding unit lower portions 902.

On the other hand, in the transition from the state of being housed in the housing of the saddle stitching apparatus 90 to the state of being disposed to the saddle stitching positions illustrated in FIG. 5, the saddle stitching units 900 move respectively in directions indicated by arrows W2 in FIG. 5. At this moment, each of the downstream-side shelf-type trays 903 rotates about the shaft 906 in a direction indicated by an arrow X2 in FIG. 5 with the biasing force of the spring 907 being gradually released in association with the movement of the unit lower portion 902 in the direction indicated by the arrow W2. In the same manner, each of the upstream-side shelf-type trays 904 rotates about the shaft 908 in the direction indicated by the arrow X2 in FIG. 5 with the biasing force of the spring 909 being gradually released in association with the movement of the unit lower portion 902 in the direction indicated by the arrow W2. As a result, the downstream-side shelf-type trays 903 and the upstream-side shelf-type trays 904 are brought into the state as illustrated in FIG. 5.

Note that, the saddle stitching units 900 are located at first stitching positions or second stitching positions in accordance with the size of sheets to be subjected to the saddle stitching process. These positions are set by adjusting the amount of movements of the saddle stitching units 900 in the directions indicated by the arrows W2.

As described above, in the second exemplary embodiment, the downstream-side shelf-type trays 903 and the upstream-side shelf-type trays 904 are provided to the unit lower portions 902 so as to be capable of being advanced and retracted. Then, the advancement and retraction of the downstream-side shelf-type trays 903 and the upstream-side shelf-type trays 904 are performed in association with the saddle stitching units 900, each including the unit lower portion 902, advanced from and retracted into the saddle stitching apparatus 90 (the advancement and retraction on both of the IN side and the OUT side). This configuration prevents sheets from sagging or falling down with the downstream-side shelf-type trays 903 deployed from the unit lower portions 902, even when the sheets are transported from the compile tray 31 toward the saddle stitching units 900 and then subjected to the stapling process while being opened.

Next, the operation of the sheet processing apparatus according to the second exemplary embodiment having the above-described configuration will be described.

First, consider a case where the user selects the edge stitching process as a post-processing mode through operation using the operating part 11 and the like. In this case, upon receipt of the selecting operation, the controller 10 first instructs the image forming part to perform an image forming process, and then instructs the edge stitching process part 4 to perform the edge stitching process. Meanwhile, the controller 10 causes the saddle stitching units 900 to be retracted to the home positions inside the housing of the saddle stitching apparatus 90.

In this way, the edge stitching process is performed by the staple heads of the edge stitching process part 4 on the bundle of a predetermined number of sheets stacked on the compile tray 31. Thereafter, the bundle of sheets subjected to the edge stitching process is discharged onto the stacking tray 8 by the rotation of the first eject roller 12*a* and the second eject roller 12*b* of the eject rollers 12 in the directions indicated by the arrows T1 in FIG. 2.

On the other hand, consider a case where the user selects the saddle stitching process as the post-processing mode through operation using the operating part 11 and the like. In this case, upon receipt of the selecting operation, the controller 10 first instructs the image forming part to perform an image forming process, and then instructs the saddle stitching apparatus 90 to perform the saddle stitching process. Meanwhile, the controller 10 causes the saddle stitching units 900 to be disposed to the stitching positions on the sheet transport path through which the bundle of sheets is to be transported, and then to wait for the bundle of sheets being transported thereto.

In this way, a sheet having a toner image formed thereon in the image forming part, and being subjected to the fixing process in the fixing part, passes through the sheet transport path 5. Then, if a crease is to be made in the sheet, the creasing part 6 makes the crease on the sheet. The sheet having passed through the portion where the creasing part 6 is disposed is detected by the exit sensor 52 and then transported by the exit rollers 51 in the direction indicated by the arrow S1, as illustrated in FIG. 2.

After the bundle of sheets is generated on the compile tray 31 in the above-described manner, the first eject roller 12*a* of the eject rollers 12 descends (moves in the direction indicated by the arrow Q1 in FIG. 2). Then, the bundle of sheets as a whole is transported, in the direction indicated by the arrow S3 in FIG. 2, toward the saddle stitching units 900 on the downstream side, by the rotations of the first eject roller 12*a* and the second eject roller 12*b* in the directions indicated by the arrows T1 in FIG. 2.

In the job start of the saddle stitching process, the saddle stitching units 900 stay at the first or second stitching position according to the sheet size. After the bundle of sheets is supplied by the eject rollers 12, the saddle stitching units 900 perform the stitching process on, for example, the portion creased by the creasing part 6, so that the bundle of sheets stitched at the center portion thereof is formed. After that, the saddle stitching units 900 are retracted from the sheet transport path, that is, the stitching positions, and the bundle of sheets is further transported to the downstream side by the eject rollers 12, so as to be discharged onto the stacking tray 8 below the stitching positions.

As described above, in the sheet processing apparatus according to the second exemplary embodiment, the saddle stitching apparatus 90 is provided above the stacking tray 8 outside the apparatus housing 100. Further, when the bundle of sheets subjected to the stitching process is stacked on the stacking tray 8, the saddle stitching units 900 are retracted from the positions on the sheet transport path. This configuration allows both the bundle of sheets subjected to the edge stitching process in the edge stitching process part 4 and the bundle of sheets subjected to the saddle stitching process in the saddle stitching process part 9 to be stacked on the same stacking tray 8. Accordingly, it is not necessary for the sheet processing apparatus to include separate stacking trays respectively for the bundle of sheets subjected to the edge stitching process and the bundle of sheets subjected to the saddle stitching process. As a result, the configuration of the apparatus may be simplified and the size of the apparatus may be reduced.

Moreover, the stacking tray 8 is allowed to ascend and descend relative to the saddle stitching apparatus 90 located above the stacking tray 8. Accordingly, a larger amount of the bundle of sheets may be stacked on the stacking tray 8 in comparison with the case where the distance between the stacking tray 8 and the saddle stitching apparatus 90 is fixed.

Third Exemplary Embodiment

A sheet processing apparatus according to a third exemplary embodiment is characterized in that the sheet processing apparatus is configured separately from the image forming apparatus 1.

Figure 6:
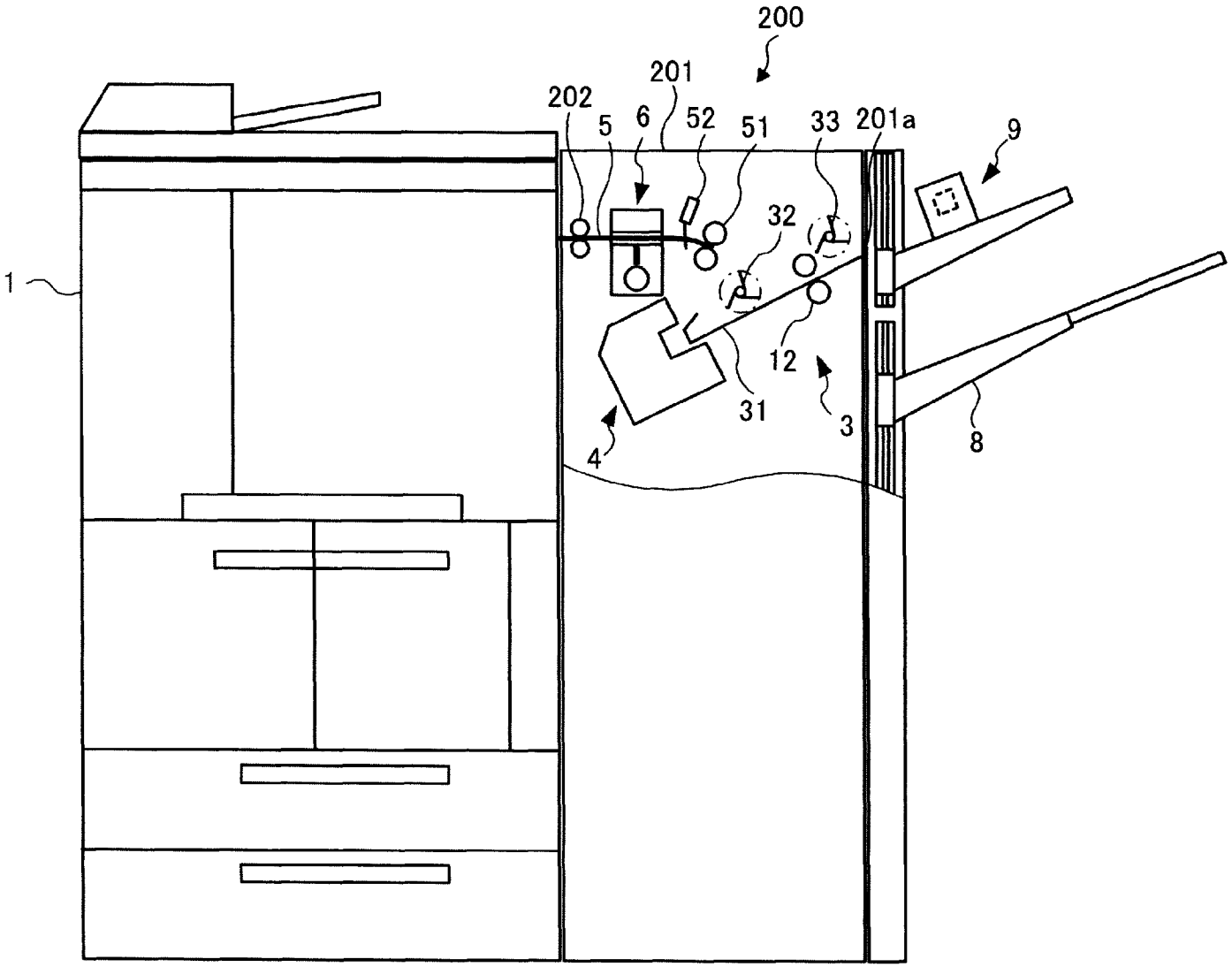
FIG. 6 is a diagram showing an entire configuration of a sheet processing system employing a sheet processing apparatus according to the third exemplary embodiment.

FIG. 6 is a diagram showing an entire configuration of a sheet processing system employing the sheet processing apparatus according to the third exemplary embodiment. In the sheet processing system illustrated in FIG. 6, for example, the image forming apparatus 1 and a sheet processing apparatus 200 that performs post processing on a sheet having, for example, a toner image formed thereon by the image forming apparatus 1 are configured to have separate housings, respectively. The sheet processing system is configured by connecting the image forming apparatus 1 and the sheet processing apparatus 200 each other. Note that, the same functions as those in the first exemplary embodiment are denoted by the same reference numerals, and will not be described in detail hereinbelow.

The sheet processing apparatus 200 includes receiving rollers 202 and a creasing part 6. The receiving rollers 202 are a pair of rollers serving as a receiving unit that receives, inside an apparatus housing 201 of the sheet processing apparatus 200, a sheet discharged from the image forming apparatus 1. The creasing part 6 makes a crease in the sheet to be transported. In addition, the sheet processing apparatus 200 includes an exit sensor 52, a compile tray 31, and exit rollers 51. The exit sensor 52 is provided on the downstream side of the creasing part 6 on a transport path, and detects the sheet. The compile tray 31 collects and accumulates multiple sheets. The exit rollers 51 are a pair of rollers that discharge the sheet toward the compile tray 31. The sheet processing apparatus 200 further includes a main paddle 32 and a sub paddle 33 each of which is constituted of a paddle that rotates in order to push the trailing edges of the sheets toward an end guide 31*a* (see FIG. 2) of the compile tray 31. Moreover, the sheet processing apparatus 200 includes eject rollers 12 that transport, to the downstream side, the bundle of sheets accumulated on the compile tray 31. Furthermore, the sheet processing apparatus 200 includes an edge stitching process part 4 that stitches an edge of the bundle of sheets inside the apparatus housing 201.

In addition, in the sheet processing apparatus 200, an opening portion 201*a* is formed in a side wall surface of the apparatus housing 201. Moreover, the sheet processing apparatus 200 includes a stacking tray 8 and a saddle stitching process part 9 on the side wall surface of the apparatus housing 201. The bundle of sheets subjected to the stitching process are stacked on the stacking tray 8, and the saddle stitching process part 9 performs the stitching process on the approximately center portion of the bundle of sheets transported thereto. As shown in FIG. 6, the stacking tray 8 is provided below the saddle stitching process part 9, so that the sheets after being subjected to the saddle stitching process by the saddle stitching process part 9 are successively stacked on the stacking tray 8.

In addition, in the sheet processing apparatus 200 according to the third exemplary embodiment, the saddle stitching process part 9 is provided to be capable of ascending and descending above the stacking tray 8 outside the apparatus housing 201. Then, the position of the saddle stitching process part 9 is changed in accordance with whether the edge stitching process by the edge stitching process part 4 is performed or the saddle stitching process by the saddle stitching process part 9 is performed. Specifically, when the edge stitching process is to be performed by the edge stitching process part 4, the saddle stitching unit 91 is moved to the aforementioned second position. On the other hand, when the saddle stitching process is to be performed by the saddle stitching process part 9, the saddle stitching unit 91 is moved to the aforementioned first position. This configuration allows both the bundle of sheets subjected to the edge stitching process in the edge stitching process part 4 and the bundle of sheets subjected to the saddle stitching process in the saddle stitching process part 9 to be stacked on the same stacking tray 8. Accordingly, it is not necessary for the sheet processing apparatus to include separate stacking trays respectively for the bundle of sheets subjected to the edge stitching process and the bundle of sheets subjected to the saddle stitching process. As a result, the configuration of the apparatus may be simplified and the size of the apparatus may be reduced.

Moreover, the stacking tray 8 is allowed to ascend and descend relative to the saddle stitching process part 9 located above the stacking tray 8. Accordingly, a larger amount of the bundle of sheets may be stacked on the stacking tray 8 in comparison with the case where the distance between the stacking tray 8 and the saddle stitching process part 9 is fixed.

Note that, as the saddle stitching process part 9, the saddle stitching apparatus 90 according to the second exemplary embodiment may be employed. Also in this case, both the bundle of sheets subjected to the edge stitching process in the edge stitching process part 4 and the bundle of sheets subjected to the saddle stitching process in the saddle stitching process part 9 may be stacked on the same stacking tray 8. As a result, the configuration of the apparatus may be simplified and the size of the apparatus may be reduced.

Moreover, the stacking tray 8 is allowed to ascend and descend relative to the saddle stitching apparatus 90 located above the stacking tray 8. Accordingly, a larger amount of the bundle of sheets may be stacked on the stacking tray 8 in comparison with the case where the distance between the stacking tray 8 and the saddle stitching apparatus 90 is fixed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing apparatus, comprising:

a sheet aligning part that accumulates and aligns sheets so as to generate a bundle of sheets;

an edge stitching processor that performs an edge stitching process by which the bundle of sheets generated in the sheet aligning part is stitched together at one edge of the bundle of sheets;

an apparatus housing that includes an opening portion through which the bundle of sheets is discharged to an outside of the apparatus housing;

a saddle stitching processor that performs, outside of the apparatus housing, a saddle stitching process by which the bundle of sheets discharged through the opening portion is stitched together at a center portion of the bundle of sheets in a transporting direction of the bundle of sheets; and a stacking tray that is provided below the opening portion and outside the apparatus housing, and on which the bundle of sheets subjected to the edge stitching process in the edge stitching processor is capable of being stacked, and the bundle of sheets subjected to the saddle stitching process in the saddle stitching processor is also capable of being stacked, wherein when the bundle of sheets subjected to the edge stitching process in the edge stitching processor is discharged through the opening portion and stacked on the stacking tray, the saddle stitching processor is retracted so as not to interfere with the stacking of the bundle of sheets and wherein the saddle stitching processor is disposed to a stitching position on a transport path for the bundle of sheets when performing the saddle stitching process and the saddle stitching processor moves from the stitching position in a direction perpendicular to the transporting direction of the bundle of sheets being discharged through the opening portion when the bundle of sheets is to be stacked on the stacking tray upon the completion of the saddle stitching process.

2. The sheet processing apparatus according to claim 1, wherein the saddle stitching processor is disposed to a stitching position on a transport path for the bundle of sheets when performing the saddle stitching process, while moving from the stitching position in a direction perpendicular to a transporting direction of the bundle of sheets when the bundle of sheets subjected to the edge stitching process is discharged through the opening portion.

3. The sheet processing apparatus according to claim 1, wherein the stacking tray is movable upward and downward relative to the saddle stitching processor.

4. The sheet processing apparatus according to claim 1, wherein the apparatus housing serves also as a housing of an image forming apparatus, and the sheet aligning part accumulates and aligns sheets on which respective images are formed, so as to generate a bundle of sheets.

5. The sheet processing apparatus according to claim 1, wherein the saddle stitching processor is provided above the stacking tray, performs the saddle stitching process on the bundle of sheets discharged through the opening portion, and causes the bundle of sheets subjected to the saddle stitching process to fall down onto the stacking tray.

6. The sheet processing apparatus according to claim 1, wherein when the bundle of sheets subjected to the saddle stitching process in the saddle stitching processor is stacked on the stacking tray, the saddle stitching processor moves from the stitching position in the direction perpendicular to the transporting direction of the bundle of sheets being discharged through the opening portion and in parallel with a surface of the bundle of sheets at the stitching position.

7. A sheet processing apparatus comprising:

a receiving unit that receives, into a housing, a sheet discharged from an image forming apparatus;

a sheet aligning part that accumulates and aligns sheets each having received by the receiving unit, so as to generate a bundle of sheets;

an opening portion through which the bundle of sheets generated in the sheet aligning part is discharged to an outside of the housing;

an edge stitching processor that performs an edge stitching process by which the bundle of sheets is stitched together at one edge of the bundle of sheets;

a saddle stitching processor that performs a saddle stitching process by which the bundle of sheets is stitched together at a center portion of the bundle of sheets in a transporting direction of the bundle of sheets; and a stacking tray on which the bundle of sheets subjected to the edge stitching process in the edge stitching processor is capable of being stacked, and the bundle of sheets subjected to the saddle stitching process in the saddle stitching processor is also capable of being stacked, wherein when the bundle of sheets subjected to the edge stitching process in the edge stitching processor is discharged through the opening portion and stacked on the stacking tray, the saddle stitching processor is retracted so as not to interfere with the stacking of the bundle of sheets and wherein the saddle stitching processor is disposed to a stitching position on a transport path for the bundle of sheets when performing the saddle stitching process and the saddle stitching processor moves from the stitching position in a direction perpendicular to the transporting direction of the bundle of sheets being discharged through the opening portion when the bundle of sheets is to be stacked on the stacking tray upon the completion of the saddle stitching process.

8. The sheet processing apparatus according to claim 7, wherein the stacking tray is provided outside the housing and below the opening portion, and the saddle stitching processor is provided outside the housing and above the stacking tray, performs the saddle stitching process on the bundle of sheets discharged through the opening portion, and causes the bundle of sheets subjected to the saddle stitching process to fall down onto the stacking tray.

9. The sheet processing apparatus according to claim 8, wherein the edge stitching processor is provided inside the housing.

10. The sheet processing apparatus according to claim 7, wherein when the bundle of sheets subjected to the saddle stitching process in the saddle stitching processor is stacked on the stacking tray, the saddle stitching processor moves from the stitching position in the direction perpendicular to the transporting direction of the bundle of sheets being discharged through the opening portion and in parallel with a surface of the bundle of sheets at the stitching position.

* * * * *